US010117510B2

(12) United States Patent
Rehkemper et al.

(10) Patent No.: US 10,117,510 B2
(45) Date of Patent: Nov. 6, 2018

(54) PORTABLE ADJUSTABLE DESK SYSTEM

(71) Applicant: THE EDGE DESK SYSTEM, LLC, Deerfield, IL (US)

(72) Inventors: Jeffrey Rehkemper, Chicago, IL (US); Steven Rehkemper, Chicago, IL (US); Marc J. Rosenberg, Deerfield, IL (US); Jeffrey M. Jones, Deerfield, IL (US)

(73) Assignee: The Edge Desk System, LLC, Deerfield, IL (US)

( * ) Notice: Subject to any disclaimer, the term of this patent is extended or adjusted under 35 U.S.C. 154(b) by 0 days.

(21) Appl. No.: 15/528,646

(22) PCT Filed: Nov. 20, 2015

(86) PCT No.: PCT/US2015/061912

§ 371 (c)(1),
(2) Date: May 22, 2017

(87) PCT Pub. No.: WO2016/081857

PCT Pub. Date: May 26, 2016

(65) Prior Publication Data

US 2017/0251803 A1 Sep. 7, 2017

Related U.S. Application Data

(60) Provisional application No. 62/123,502, filed on Nov. 20, 2014.

(51) Int. Cl.
*A47B 39/02* (2006.01)
*A47C 7/62* (2006.01)
(Continued)

(52) U.S. Cl.
CPC ..... *A47B 3/14* (2013.01); *A47B 3/02* (2013.01); *A47B 9/20* (2013.01); *A47B 13/02* (2013.01);
(Continued)

(58) Field of Classification Search
CPC .... A47B 3/02; A47B 3/14; A47B 9/20; A47B 13/081; A47B 13/16; A47B 83/008; A47B 83/02; A47B 39/06; A47B 2083/025
(Continued)

(56) References Cited

U.S. PATENT DOCUMENTS 3,034,827 A 5/1962 Rassier
4,650,249 A * 3/1987 Serber ..... A47C 9/005 297/423.11 X
(Continued)

FOREIGN PATENT DOCUMENTS

CN 88200667 11/1988
CN 2030041 1/1989
(Continued)

OTHER PUBLICATIONS

International Search Report for PCT/US2015/061912, Completed by the Korean Patent Office on Feb. 29, 2016, 3 Pages.
(Continued)

*Primary Examiner* — Rodney B White
(74) *Attorney, Agent, or Firm* — Brooks Kushman P.C.

(57) ABSTRACT

A collapsible desk system is provided. The desk system may include first and second elongate members having a common central pivot and being pivotal relative to one another in a scissor-like manner. A seat may be attached to one of the elongate members. A support member may be cooperable with the elongate members to selectively retain the elongate members in one or more orientations. A desk top may be pivotally attached to a column. The members, seat, column, and desk top may be arranged with one another to transition between at least a collapsed and an expanded position. A knee support may be mounted to one of the elongate members. The desk top may define a side face having a groove extending about at least a portion of a perimeter of
(Continued)

the desk top and the groove may be sized to receive a first fastener tab of an accessory.

20 Claims, 19 Drawing Sheets

(51) Int. Cl.

| | |
|---|---|
| ***A47B 3/14*** | (2006.01) |
| ***A47B 13/02*** | (2006.01) |
| ***A47B 3/02*** | (2006.01) |
| ***A47B 39/06*** | (2006.01) |
| ***A47B 9/20*** | (2006.01) |
| ***A47B 13/08*** | (2006.01) |
| ***A47B 13/16*** | (2006.01) |
| ***A47B 83/00*** | (2006.01) |
| ***A47B 83/02*** | (2006.01) |
| ***A47C 9/00*** | (2006.01) |

(52) U.S. Cl.
CPC ..... *A47B 13/081* (2013.01); *A47B 13/16* (2013.01); *A47B 39/06* (2013.01); *A47B 83/008* (2013.01); *A47B 83/02* (2013.01); *A47C 9/005* (2013.01); *A47B 2083/025* (2013.01)

(58) Field of Classification Search
USPC ..... 297/160, 161, 170, 172, 173, 174 R, 297/188.01, 188.2, 217.6, 423.11, 423.12
See application file for complete search history.

(56) References Cited

U.S. PATENT DOCUMENTS

| | | | | | |
|---|---|---|---|---|---|
| 4,798,411 | A | 1/1989 | Lin | | |
| 4,861,102 | A * | 8/1989 | Fuller | A47C 7/68 | 297/188.2 X |
| 4,878,641 | A * | 11/1989 | Vogt | A47F 7/021 | 211/85.1 |
| 4,930,740 | A * | 6/1990 | Vogt | A47F 7/021 | 211/85.1 |
| 5,186,519 | A * | 2/1993 | Larson | A47C 9/005 | 297/423.12 X |
| 5,401,078 | A * | 3/1995 | Riach | A47C 7/503 | 297/423.11 X |
| 5,413,400 | A | 5/1995 | Llanes | | |
| 5,542,746 | A * | 8/1996 | Bujaryn | A47C 9/002 | 297/423.12 X |
| 5,669,669 | A * | 9/1997 | Usher | A47C 9/005 | 297/423.11 X |
| 5,692,272 | A * | 12/1997 | Woods | A44B 99/00 | 24/115 M |
| 5,720,517 | A * | 2/1998 | Prothro, Sr. | A47C 7/503 | 297/423.12 X |
| 5,762,402 | A * | 6/1998 | Gillotti | A47C 9/005 | 297/423.11 X |
| 5,961,179 | A | 10/1999 | Dixon et al. | | |
| 5,971,485 | A * | 10/1999 | Clark | A61G 13/009 | 297/423.11 X |
| 5,988,738 | A * | 11/1999 | Blessing | A47B 3/14 | 297/423.11 X |
| 6,010,186 | A | 1/2000 | Tsay | | |
| 6,065,808 | A * | 5/2000 | Tinsley | A47C 9/005 | 297/423.11 X |
| 6,484,989 | B1 * | 11/2002 | Connery | A47D 1/008 | 297/188.2 X |
| 6,543,853 | B1 * | 4/2003 | Splane, Jr. | A47C 9/005 | 297/423.11 X |
| 6,729,690 | B2 * | 5/2004 | Roleder | A47C 9/005 | 297/423.12 X |
| 6,769,736 | B2 * | 8/2004 | Roleder | A47C 9/005 | 297/423.12 X |
| 7,144,080 | B2 * | 12/2006 | Lloyd | A47C 9/005 | 297/423.12 X |
| 7,367,623 | B2 * | 5/2008 | Tholkes | A47C 9/005 | 297/423.11 X |
| 7,591,773 | B2 * | 9/2009 | Weir | A63B 21/055 | 297/423.11 X |
| 7,922,249 | B2 | 4/2011 | Marchand | | |
| 8,485,490 | B1 * | 7/2013 | Miller | A47C 7/62 | 297/188.01 X |
| 8,636,319 | B1 * | 1/2014 | Parker, Jr. | A47C 7/62 | 297/188.2 X |
| 2002/0067060 | A1 * | 6/2002 | Lloyd | A47C 9/005 | 297/423.11 X |
| 2002/0171271 | A1 * | 11/2002 | Jennings | A47C 7/70 | 297/188.01 |
| 2003/0177960 | A1 | 9/2003 | Schenker et al. | | |
| 2004/0070253 | A1 * | 4/2004 | Murphy | A61G 15/00 | 297/423.11 |
| 2006/0197362 | A1 | 9/2006 | Mabon et al. | | |
| 2007/0052275 | A1 * | 3/2007 | Ghilzai | A47C 1/06 | 297/423.12 |
| 2009/0140567 | A1 | 6/2009 | Weiss | | |
| 2009/0284064 | A1 * | 11/2009 | Maynard, Jr. | A47C 9/005 | 297/423.12 |
| 2011/0121619 | A1 * | 5/2011 | Chappell | A47C 7/62 | 297/188.01 |
| 2016/0302571 | A1 * | 10/2016 | McBride | A47B 19/06 | |
| 2017/0105523 | A1 * | 4/2017 | McBride | A47B 83/02 | |
| 2017/0259111 | A1 * | 9/2017 | Hsieh | A63B 22/0605 | |
| 2017/0265643 | A1 * | 9/2017 | Stolze | A47B 19/08 | |
| 2018/0125233 | A1 * | 5/2018 | Leier | A47B 13/023 | |
| 2018/0184801 | A1 * | 7/2018 | Thomson | A47B 39/06 | |

FOREIGN PATENT DOCUMENTS

| | | | | |
|---|---|---|---|---|
| CN | 2073695 | 3/1991 | | |
| CN | 2091095 | 12/1991 | | |
| CN | 2124627 | 12/1992 | | |
| CN | 2244865 | 1/1997 | | |
| CN | 2260506 | 8/1997 | | |
| CN | 2855194 | 1/2007 | | |
| CN | 201349717 | 11/2009 | | |
| CN | 201403851 | 2/2010 | | |
| CN | 102008184 | 4/2011 | | |
| CN | 204032727 | 12/2014 | | |
| CN | 204091355 | 1/2015 | | |
| CN | 204105217 | 1/2015 | | |
| CN | 104687823 | 6/2015 | | |
| CN | 104687824 | 6/2015 | | |
| CN | 204541218 | 8/2015 | | |
| CN | 204635420 | 9/2015 | | |
| DE | 675903 | 5/1939 | | |
| DE | 874366 | 4/1953 | | |
| DE | 2261086 | 6/1974 | | |
| KR | 100715988 | 5/2007 | | |
| WO | WO-8800016 A1 * | 1/1988 | | A47C 9/005 |

OTHER PUBLICATIONS

"Website retrieved from Wayback Machine on May 19, 2016, Dated Jun. 11, 2015, All together 3 Pages, ""Flash Furniture Mobile Wooden Ergonomic Kneeling Chair in Black Fabric (FLA-WL-SB-210-GG)"", http://www.schooloutlet.com/Mobile_Wooden_Ergonomic_Kneeling_Chair_in_Black_p/fla-wl-sb-210-gg.htm?"

"Website retrieved from Wayback Machine on May 19, 2016, Dated Nov. 20, 2014, All together 5 Pages, ""Flash Furniture HF-309AST-RT-GG Premium Steel Folding Chair with Right Handed Tablet Arm, Beige/Grey"", http://www.amazon.com/Flash-Furniture-HF-309AST-RT-GG-Premium-Folding/dp/B001EJP2W2".

"Website Retrieved from Wayback Machine on May 19, 2016, Dated Feb. 19, 2014, All together 4 Pages, ""Martin Universal Design Berkeley 4 Piece Melamine Drafting Table Set with Chair"", http://www.wayfair.com/Martin-Universal-Design-Berkeley-4-Piece-Melamine-Drafting-Table-Set-with-Chair-U-DS14041XX-MUD1006.html".

(56) References Cited

OTHER PUBLICATIONS

"Website Retrieved from Wayback Machine on May 23, 2016, Dated Oct. 3, 2014, All together 11 Pages, ""Tuvie, Foldable and Compact Table and Chair for Traveling"", http://www.tuvie.com/foldable-and-compact-table-and-chair-for-traveling/".
"Website Retrieved from the Internet on May 23, 2016, Dated Aug. 27, 2015, 4 Pages, ""Home Furniture Design, Folding Beach Chair Plans."", http://www.stagecoachdesigns.com/folding-beach-chair/folding-beach-chair-plans/".

* cited by examiner

PORTABLE ADJUSTABLE DESK SYSTEM

CROSS-REFERENCE TO RELATED APPLICATION

This application is the U.S. national phase of PCT Application No. PCT/US2015/061912 filed on Nov. 20, 2015, which claims the benefit of U.S. provisional Application No. 62/123,502 filed Nov. 20, 2014, the disclosures of which are incorporated in their entirety by reference herein.

TECHNICAL FIELD

This disclosure relates to a portable desk system which may transition between at least a collapsed position and open position.

BACKGROUND

Conventional office chairs and other chairs that are used with desks in a school or home setting may offer very little control for either posture or position relative to a surface of the desk. Further, conventional school desks offer no adjustability to correct the relationship of the chair to the desk surface as best suited for the size of the person. Mobile lifestyles have expanded types of workspaces in comparison to past conventional settings. People seek comfort for the hours they spend working each day as well as portability. Typical desks may not provide users with feasible transport or storage options.

SUMMARY

A collapsible desk system includes first and second elongate members having a common central pivot and being pivotal relative to one another in a scissor-like manner. Each of the first and second elongate members has a first end for resting on an underlying surface and second end. A seat is attached to the second end of the first elongate member. A support member is cooperable with the first and second elongate members to selectively retain the elongate members in one or more crossed orientations. A column has upper and lower ends, the lower end pivotally attached to the second end of the second elongate member. A desk top is pivotally attached to the upper end of the column. The members, seat, column, and desk top are arranged with one another to transition between at least a collapsed and an expanded position. The system may include a knee support mounted to one of the elongate members. The system may include a swivel mechanism to rotate the desk top about a swivel axis normal to the desk top. The desk top may define a rectangular shape and the swivel mechanism may be configured to enable the desk top to rotate ninety degrees. The swivel mechanism and the pivotal attachment of the desk top may cooperate to orient the desk top in an easel configuration in which the desk top is in a substantially upright position relative to the underlying surface. The desk top may pivot about a generally horizontal transverse axis relative to the column. The support member may be a strut pivotally connected to one of the elongate members and engageable with the other of the elongate members at a plurality of spaced apart locations in order to vary the desk height when the system is in the expanded position. The support member may be pivotally attached to one of the elongate members. The seat may be pivotally attached to one of the elongate members. The system may define a height of less than one foot relative to the underlying surface when in the collapsed position. The desk top may define a side face having a groove extending about at least a portion of a perimeter of the desk top with the groove sized to receive a first fastener tab of an accessory. The groove may extend around substantially all of the perimeter of the desk top. The first fastener tab may define a mount cooperable with the accessory such that the accessory may rotate between at least a first and second position. The column may be telescopic to adjust a height of the desk relative to the underlying surface. A lock mechanism may selectively engage the column in one or more positions. A lock mechanism at the pivotal attachment of the desk top to the column may selectively engage the desk top in one or more positions. A lock mechanism at the pivotal attachment of the column and the second elongate member may selectively engage the column in one or more positions. A front support member and a rear support member may rest on the underlying surface and each of the members may extend along an axis parallel with a transverse axis of the system. At least one of the elongate members may include a pair of transversely spaced apart elongate members on opposed transverse sides of the other elongate member. A knee support may be mounted to one of the elongate members. An accessory may be attached to a groove defined by a side face of the desk and pivotal between a cantilevered outboard position and an inboard position partially extending over a portion of the desk. The accessory may be selected from a group of a light device, a mobile phone dock, a tablet dock, a cup holder, a utensil receptacle, a speaker, a snack tray, a makeup mirror, a cord organizer, a book holder, a file receptacle, one or more clips, or an art supply holder.

A workspace system includes a desk top defining a top surface, a side surface, and a groove in the side surface extending about at least a portion of a perimeter of the desk top. The groove is sized to receive one or more fasteners of one or more corresponding components such that the one or more components do not extend over the desk top surface in at least a first position. The system may include a support structure supporting the desk top thereon with a lower portion for resting on an underlying surface and an upper portion. The system may include a seat assembly mounted to the upper portion of the support structure and having a seat and knee support. The support structure is arranged with the desk top to position a user proximate the top surface. The seat or knee support may be sized for removable covers to be attached thereto. The components may be selected from a group of a light device, a mobile phone dock, a tablet dock, a cup holder, a utensil receptacle, a speaker, a snack tray, a makeup mirror, a cord organizer, a book holder, a file receptacle, one or more clips, or an art supply holder. The one or more corresponding components may be pivotally mounted to the one or more fasteners such that the one or more corresponding accessories may pivot to extend over the top surface in a second position.

A reconfigurable desk system includes a support structure, a column, a desk top, a swivel mechanism, and a seat assembly. The support structure has first and second elongate members for at least partially resting on an underlying surface. The column has a first end mounted to one of the elongate members and a second end. The desk top is pivotally mounted to the column at a pivot assembly. The swivel mechanism is cooperable with the desk top to rotate the desk top about an axis normal thereto. The seat assembly is mounted to the support structure to position a user proximate the desk top. The pivot assembly and swivel mechanism are arranged with one another such that the desk may transition between a landscape configuration in which the desk is oriented in a substantially horizontal position relative to the underlying surface and an easel configuration in which the desk is oriented in a substantially upright position relative to the underlying surface. A knee support may be mounted to one of the elongate members and arranged with the seat assembly such that a posture of a user positioned thereon is defined by a substantially upright seated position optimal for spinal health of the user. The desk top may define a side face extending about a perimeter thereof and have a groove sized to receive a fastener tab of an accessory. An accessory may be attached at the groove and pivotal between at least first and second positions. The column may be pivotally mounted to one of the elongate members to adjust a location of the desk top relative to the seat assembly.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ embodiments of the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
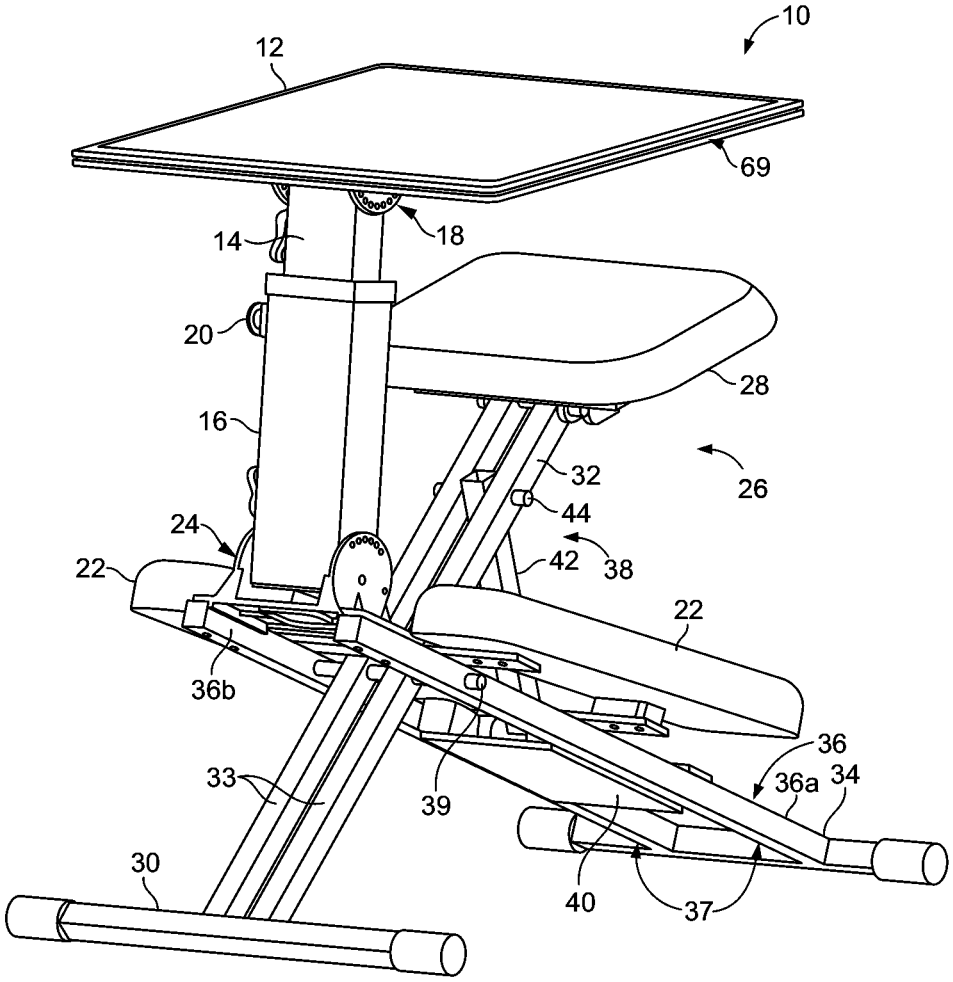
FIG. 1 is a front perspective view of a first embodiment of a novel seat and desk system.
Figure 2:
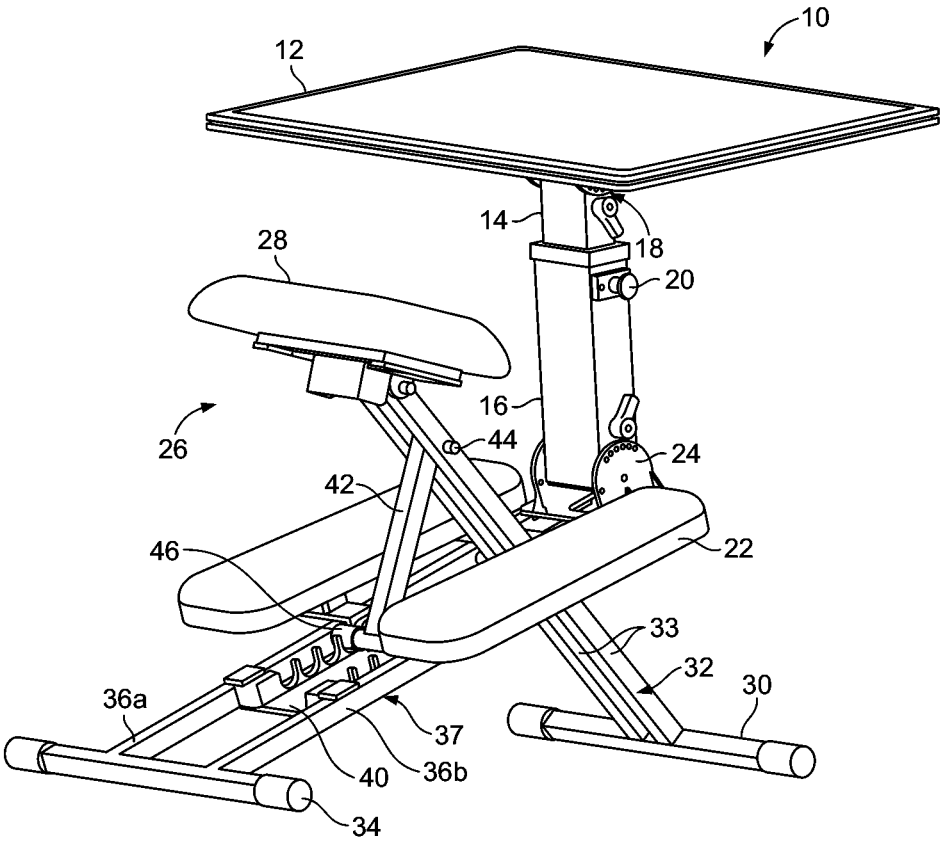
FIG. 2 is a rear perspective view of the novel system set forth in FIG. 1.

Reference is first made to FIGS. 1 and 2 of the drawings which illustrate perspective views of the front and back of an example of a desk system, referred to generally as a desk system 10 herein. Components of the desk system 10 are arranged with one another such that the desk system 10 may transition between multiple configurations and positions. For example, the desk system 10 may transition between at least a collapsed or folded position and an expanded or open position. The desk system 10 may include an integrated seating and work surface that can easily fold for simple and convenient storage and easy transport. When assembled the system includes an adjustable work desk with an integrated clip system that allows for a variety of desk and work accessories to be attached to the edge of the work surface leaving the entire work surface clear. These accessories may provide, for example, storage, lighting, and/or entertainment.

In one example of the desk system 10, there is no tool assembly required and as previously indicated the desk system 10 may readily be folded flat for easy storage and portability and quickly opened and adjusted to a desired position or configuration. The desk system 10 may include a top with a channel cut and a plastic trap which permits insertion and attachment of the accessories. The desk system 10 may provide a custom workplace without sacrificing desk space. Adjustability of the desk system 10 may accommodate a variety of different sized users and may positively influence a user's posture while seated.

While several modifications will be illustrated and described the common elements will be given the same numerals. It is noted that various elements will change in detail but their functions will not.

Continuing to refer to FIGS. 1 and 2, the desk system 10 includes a desk top 12 supported by columns consisting of inner and outer columns 14, 16. The inner column 14 is connected to a desk top 12 by a pivot assembly 18 so the desk top 12 can be pivoted relative to the inner column 14. The inner column 14 may have an upper end and the outer column 16 may have a lower end. The inner column 14 and the outer column 16 may have a telescoping relationship. Various shapes may be suitable for the desk top 12. For example, the desk top 12 may define a rectangular or square shape. A configuration of the desk top in FIG. 1 may be referred to as a landscape configuration herein. The pivot assembly 18 may include a work surface lock out mechanism (further detail shown in FIGS. 9*b* and 9*c*) to lock the desk top 12 in position when components of the desk top system 10 are moved to one or more positions including an open position. For example, the lock out mechanism may be selectively engaged to orient the desk top 12 in the one or more positions. It is contemplated that other suitable lock mechanisms may be available to secure the desk top 12 and inner column 14 in a position.

The inner and outer columns 14, 16 may define openings (not shown) for a pin 20 to extend therethrough and retain the columns 14, 16 in the desired position. For example, the desk top 12 may translate to adjust a distance between an underlying surface and the desk top 12 and/or to adjust a distance between the underlying surface and a seat assembly 26.

A pivot assembly 24 assists in enabling pivotal movement of the outer column 16 and a knee support assembly 22. The knee support assembly 22 may include one or more knee pads to assist in supporting a user positioned adjacent the desk top 12. It is contemplated that the knee support assembly 22 may be a single component or may include more than one component, such as multiple knee pads.

We turn now to the seat assembly 26 which is connected to a seat 28. The seat 28 is connected to a front support base 30 through a dual column assembly 32. The dual column assembly 32 may include a first elongate member 33. The first elongate member 33 may have a first end for resting on the underlying surface and a second end. The dual column assembly 32 may include two first elongate members 33 spaced apart from one another. The seat 28 may be mounted to the dual column assembly 32 for pivotal movement. For example, the seat 28 may be mounted to the second end of the first elongate member such that when the desk system 10 is oriented in a collapsed position (further described below) the seat 28 may pivot to assist in providing a more compact configuration of the desk system.

The knee support assembly 22 may be connected to a rear support base 34 through a column assembly 36. The seat assembly 26 may include a second elongate member 37. The second elongate member 37 may include a first end for resting on the underlying surface and a second end. The seat assembly 26 may include two second elongate members 37. The first elongate member 33 and the second elongate member 37 may share a common pivot and be pivotable relative to one another in a scissor-like manner. For example, the first elongate member 33 and the second elongate member 37 may share a pivot 39.

To permit pivotal movement of the seat assembly 26 and the knee support assembly 22 there is provided a pivot assembly 38. For example, the pivot assembly 38 may include a link 42. To facilitate positioning of the seat assembly 26 relative to the knee support assembly 22 a support plate 40 may be secured between braces 36*a* and 36*b* of the column assembly 36. The link 42 may be provided between a plate 40 and the seat assembly 26. One end of the link 42 may be pivotally connected to the seat assembly 26 at a pivot 44. The link 42 may operate as a support member and be cooperable with the first elongate member 33 and the second elongate member 37 to selectively retain the elongate members in one or more crossed orientations. The other end of link 42 may have a transversely extended rod 46 connected thereto which may be adjustably positioned between slots in plate 40 to receive rod 46 in various positions. For example, the link 42 may be a strut pivotally connected to one of the elongate members and engageable with the other of the elongate members at one or more spaced apart locations in order to vary a height of components of the desk system 10. The link 42 may also be pivotally attached to one of the elongate members.

Figure 3:
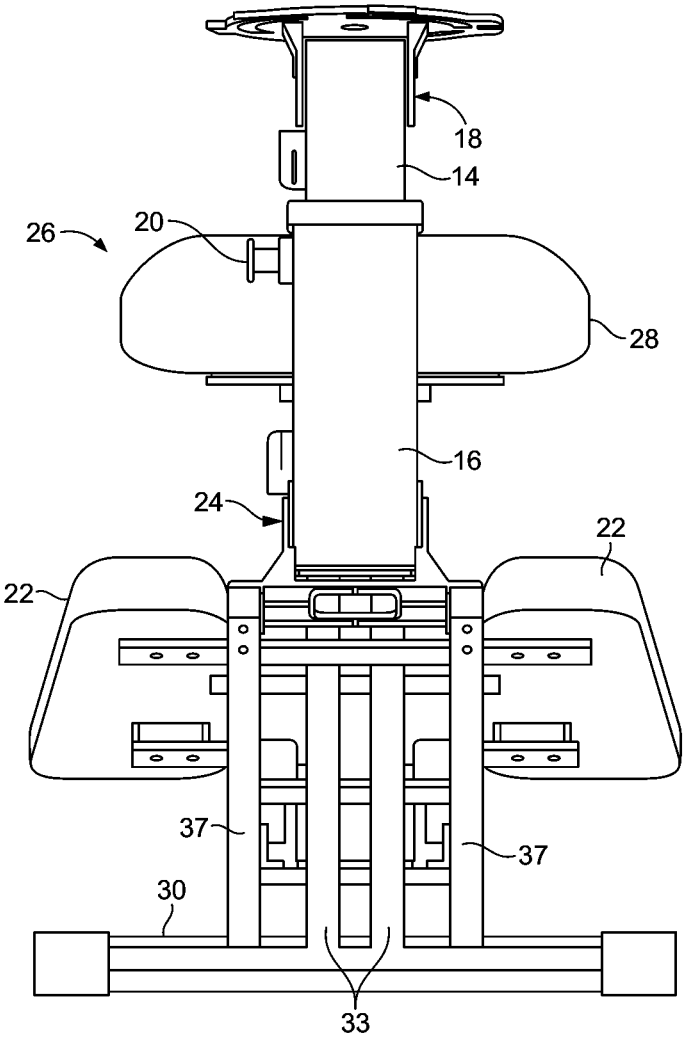
FIG. 3 is a front view of the novel system set forth in FIG. 1.
Figure 4:
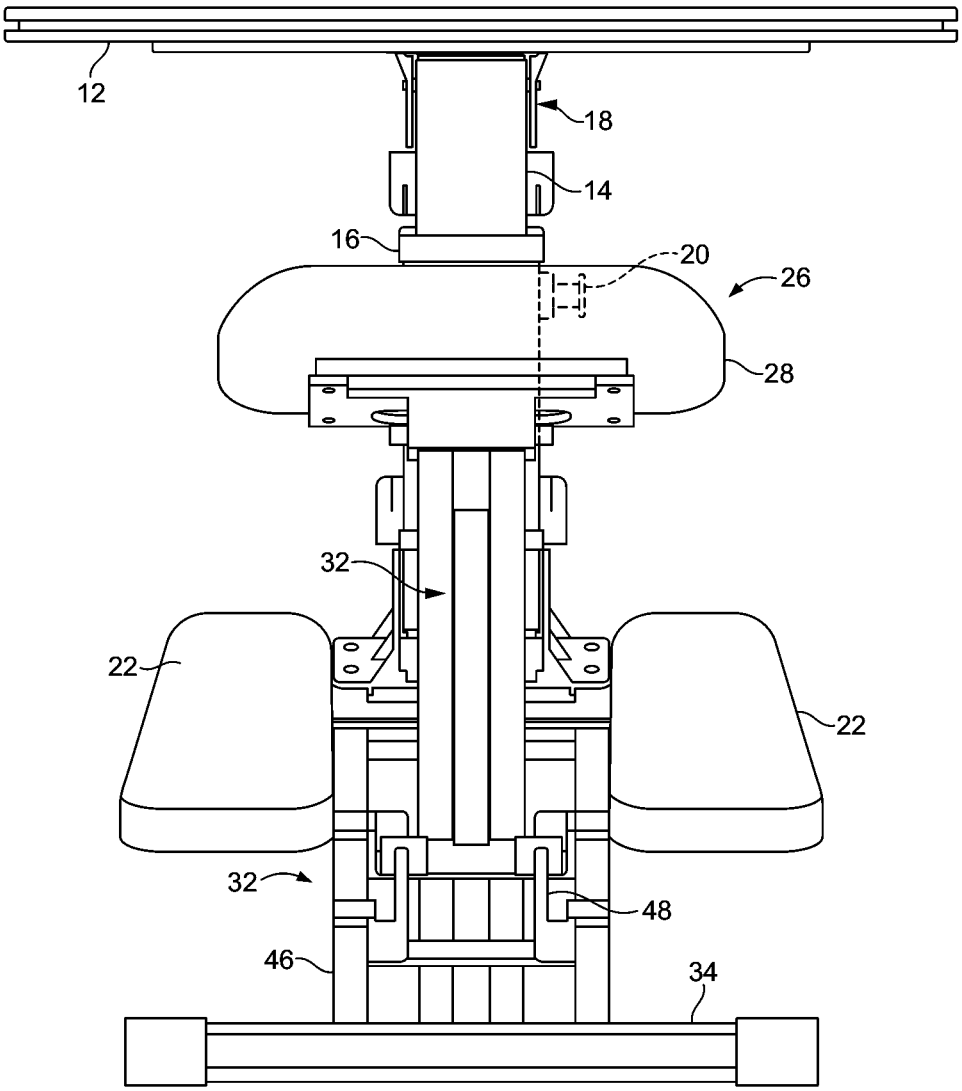
FIG. 4 is a back view of the novel system set forth in FIG. 1.

FIGS. 3 and 4 provide a front view and a back view of the desk system 10. The components thereof are appropriately numbered.

Figure 5A:
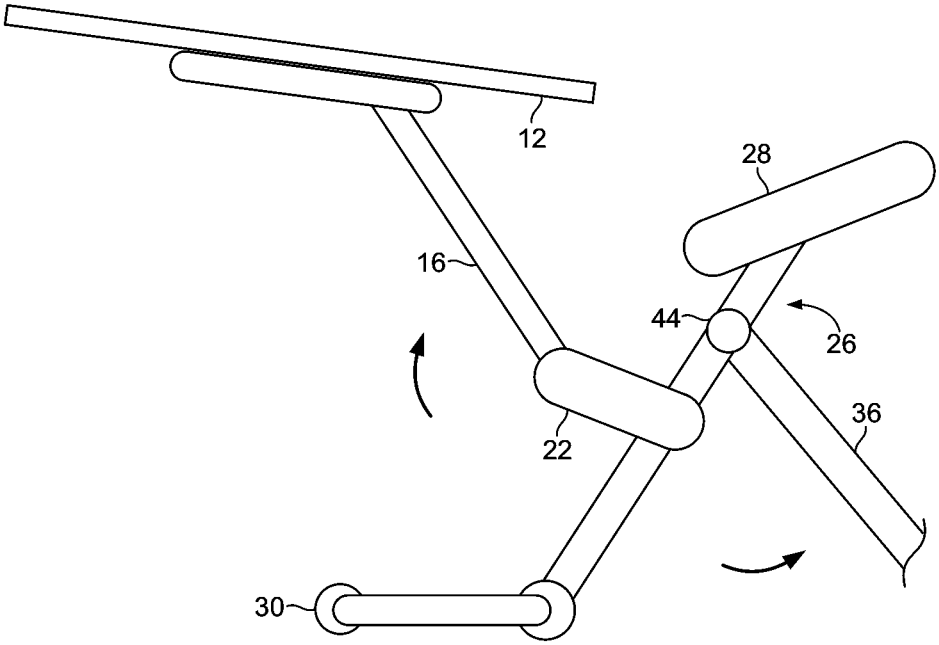
FIG. 5*a* is a schematic view of a novel system shown in the open or expanded position.
Figure 5B:
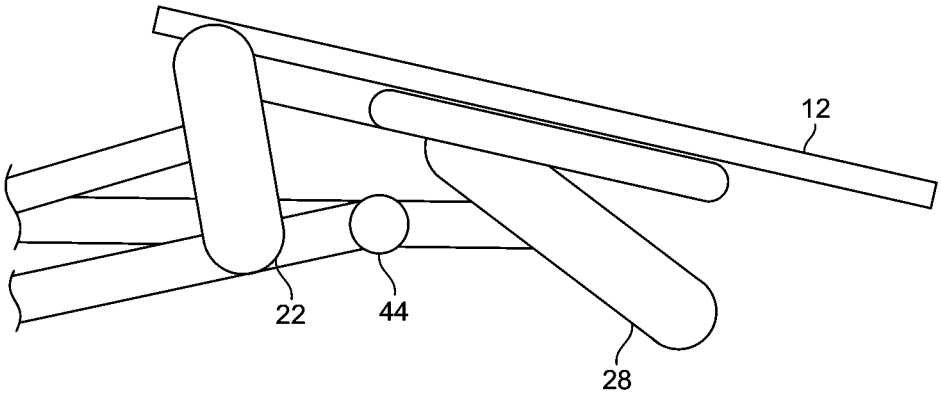
FIG. 5*b* is a schematic view of the embodiment in FIG. 5*a* shown in the collapsed or transport position.

The first and second elongate members 33, 37, the seat 28, the inner and outer columns 14, 16, and the desk top 12 may be arranged with one another to transition between at least a collapsed position and an expanded position. For example, FIG. 5*a* is a schematic view of the desk system 10 in the expanded position and FIG. 5*b* is a schematic view of the desk system 10 in the collapsed position. The desk system may define a height of less than one foot relative to the underlying surface when in the collapsed position.

Figure 6:
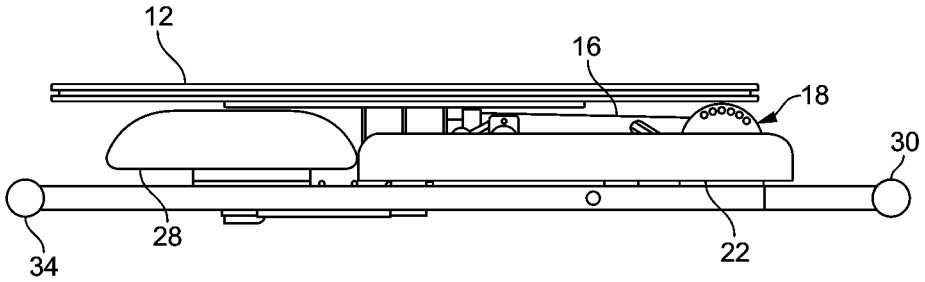
FIG. 6 is a side view of the embodiment of FIGS. 1-4 shown in the collapsed or transport position.

FIG. 6 shows the desk system 10 in the collapsed position for storage or transport. For example, the desk system 10 may fit under a user's bed or within a user's closet when in the collapsed position. As another example, the desk system 10 may be more conveniently transportable when in the collapsed position in comparison with the expanded position.

Figure 7:
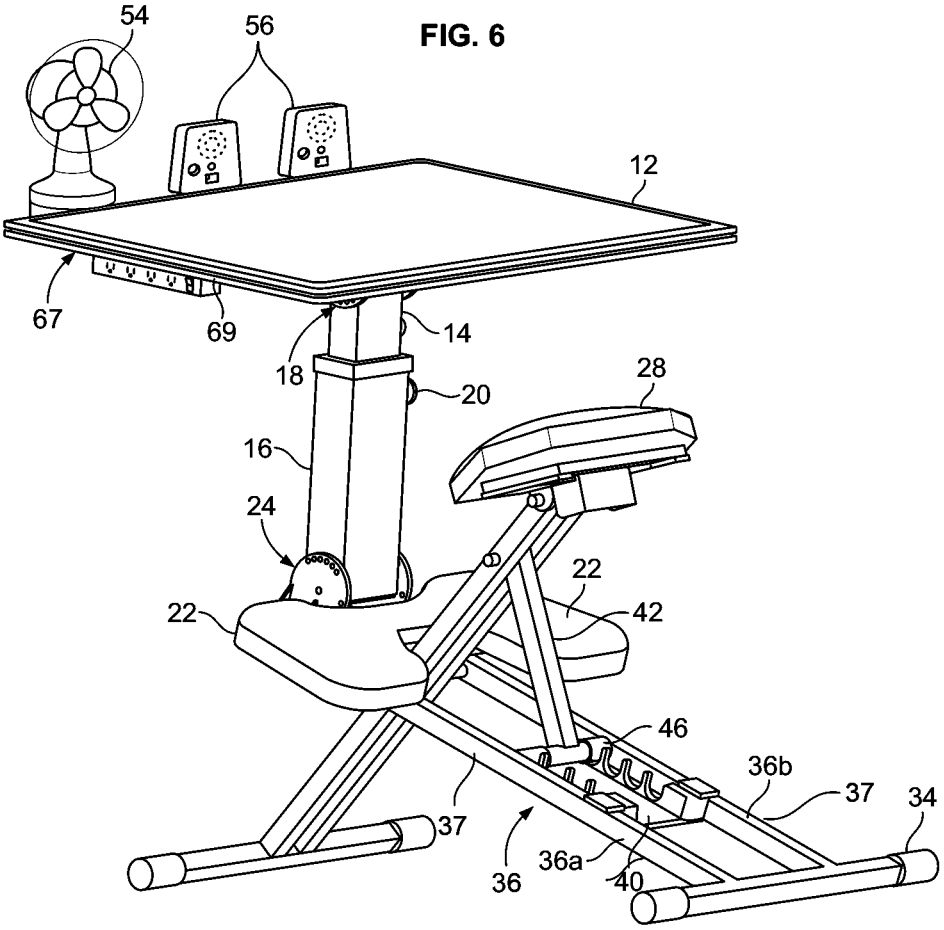
FIG. 7 is a perspective view of another embodiment of the novel desk and seat system shown in the open or expanded position with accessories attached thereto.

FIG. 7 shows another example of an embodiment of the desk system 10 oriented in the expanded position. In this example, the knee support assembly 22 is shown as a single component mounted to one or both of the second elongate members 37.

Figure 8:
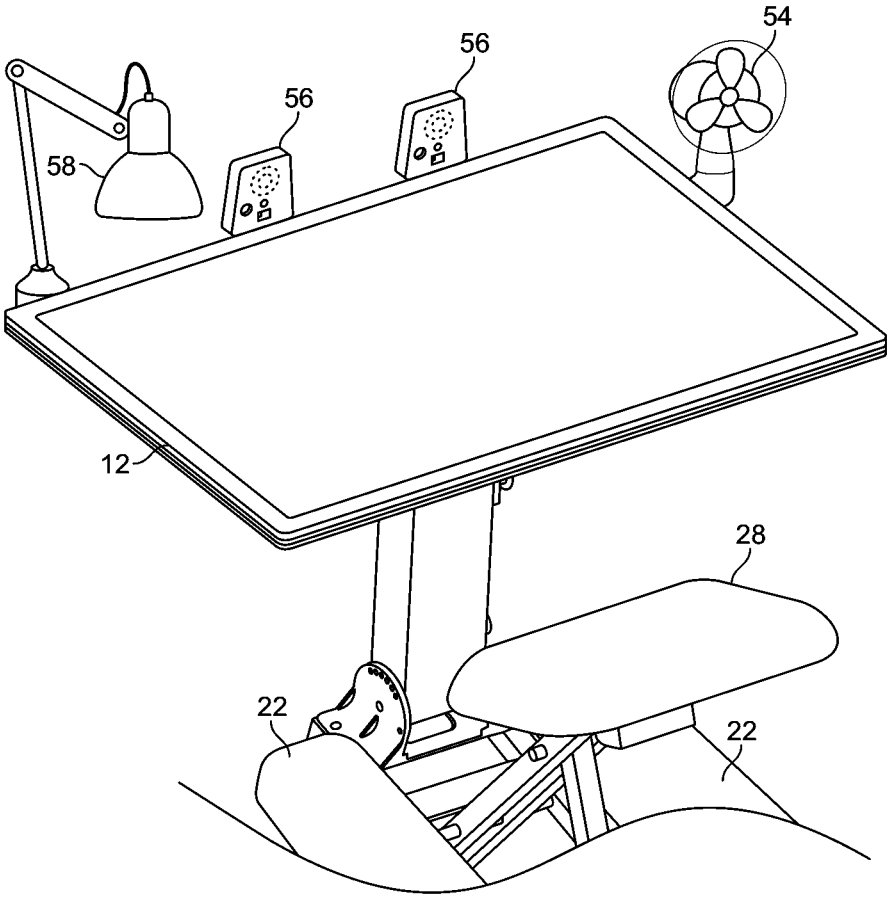
FIG. 8 is another embodiment shown in the open or expanded position.

Shown attached to the desk top 12 are various accessories including a fan 54, speakers 56, and a lighting system 58 (shown in FIG. 8). Examples of other accessories which may be removably attached to the desk top 12 include, but are not limited to, a mobile phone dock, a tablet dock, a cup holder, a utensil receptacle, a speaker, a snack tray, a makeup mirror, a cord organizer, a book holder, a file receptacle, one or more clips, or an art supply holder. The seat 28 and the knee pads of the knee support assembly 22 are of a different design than FIGS. 1 through 4 but the components thereof are otherwise similar.

FIG. 8 illustrates another embodiment showing slightly different designs of various accessories.

Figure 9A:
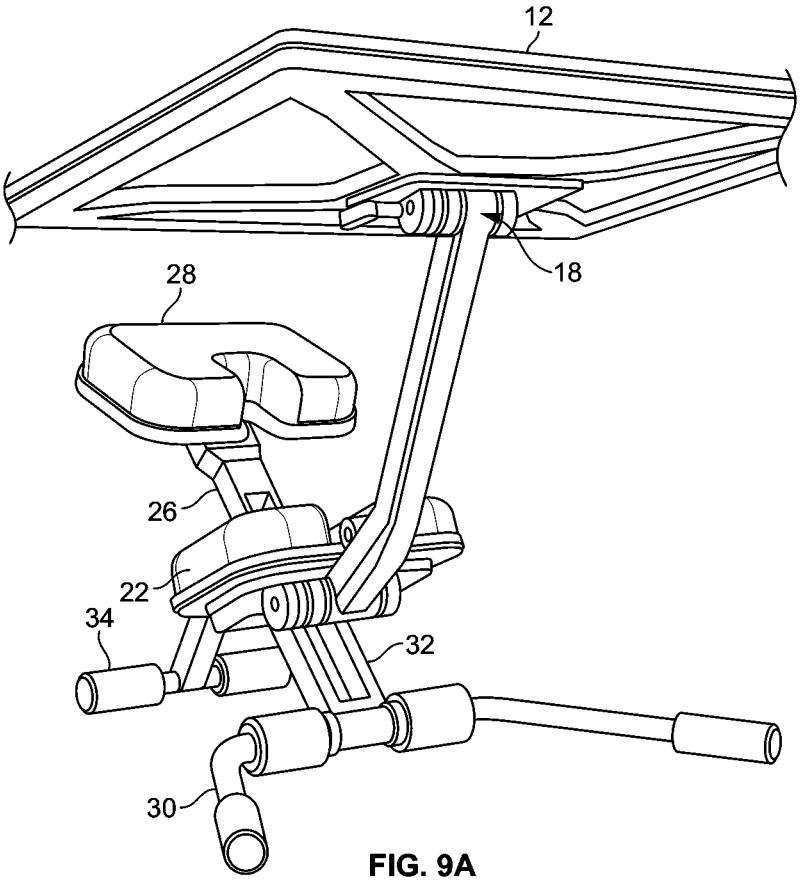
FIG. 9*a* is a front perspective view of an example of a desk system.

FIG. 9*a* illustrates another embodiment that includes similar components as the other embodiments but takes slightly different shapes and sizes that indicate the wide variations that are possible involving applicant's novel concepts.

Figure 9B:
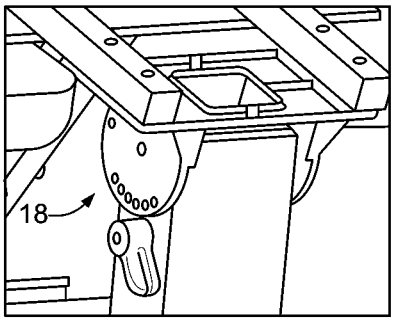
FIG. 9*b* is a detailed view of a portion of the desk system of FIG. 9*a* including a work lock-out system.

FIG. 9*b* is a detailed view of the work surface lock-out mechanism of the pivot assembly 18 for locking the work surface in a position during use.

Figure 9C:
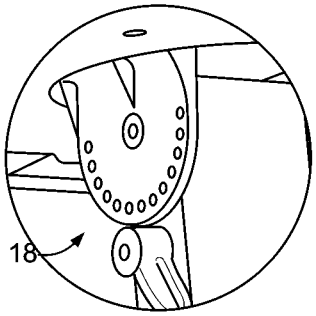
FIG. 9*c* is a detailed view of a portion of the desk system of FIG. 9*a* including a main arm dual lock-out system

FIG. 9*c* shows an example of a main arm dual lock-out system of the pivot assembly 18 for locking the inner column 14 and/or the outer column 16 in position during use.

Figure 9D:
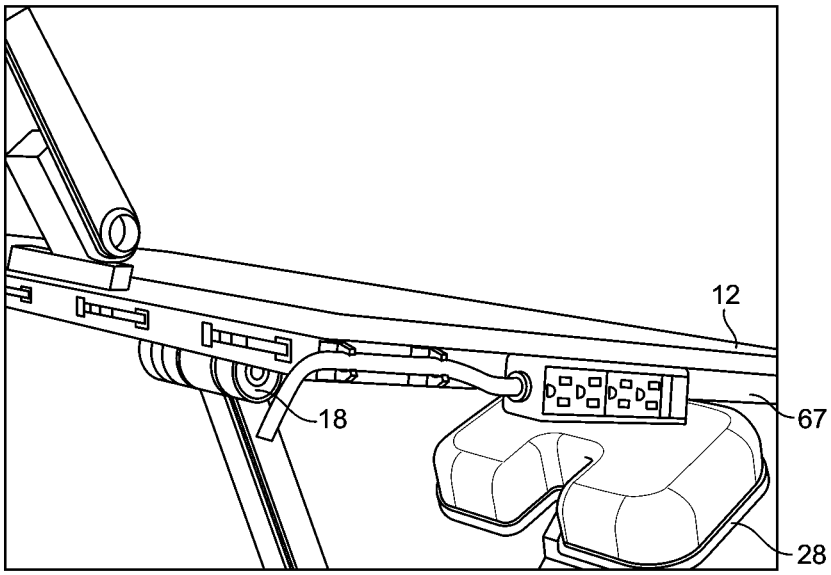
FIG. 9*d* is a detailed view of a portion of the desk system of FIG. 9*a* including a novel slot system for holding and retaining various accessories.
Figure 9E:
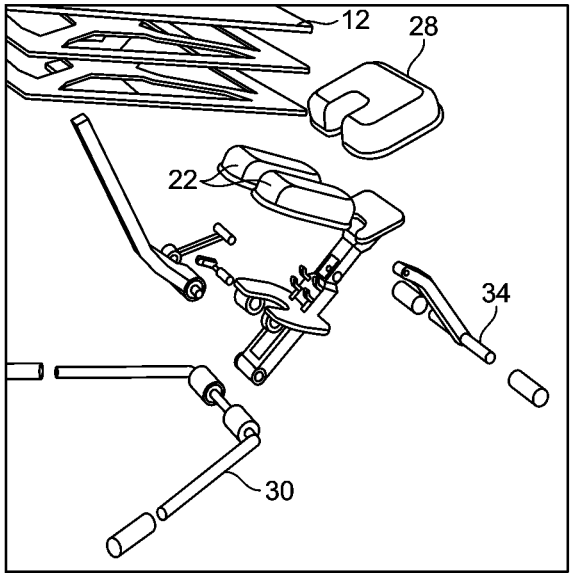
FIG. 9*e* is a partially exploded view of a portion of the desk system of FIG. 9*a* showing various components thereof.
Figure 9F:
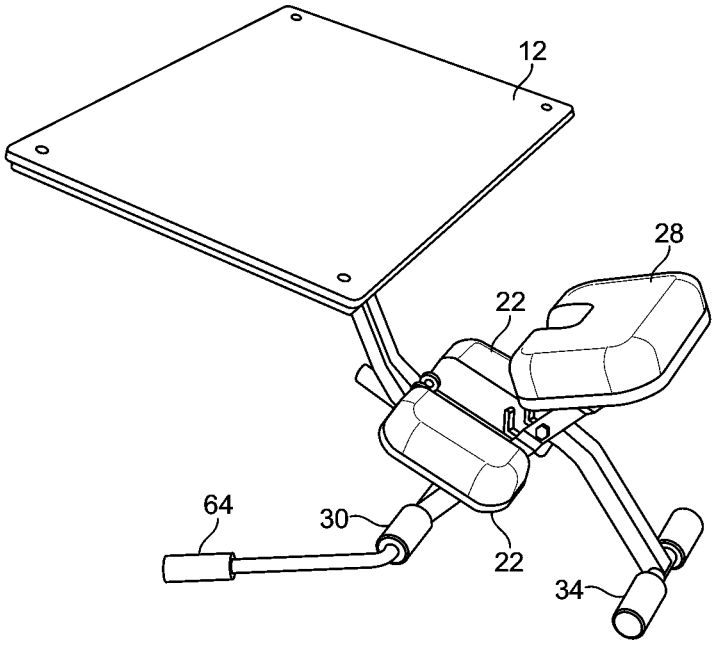
FIG. 9*f* is a side perspective view of the desk system of FIG. 9*a*.
Figure 9G:
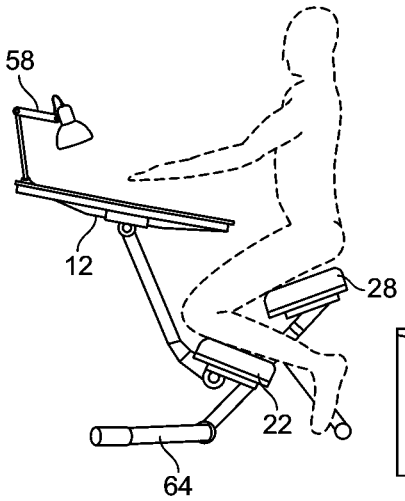
FIG. 9*g* is a side view of the desk system of FIG. 9*a* showing an example user positioned thereupon.
Figure 9H:
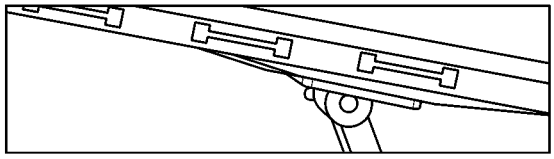
FIG. 9*h* shows a portion of the desk system of FIG. 9*a* including a slot system for attaching accessories.

FIGS. 9*d* and 9*h* illustrate the novel slot system for attaching various accessories. For example, the desk top 12 may define a side face 67 extending about a perimeter thereof. The side face 67 may have a groove 69 (best shown in FIG. 17) extending about at least a portion of the perimeter of the desk top 12. In another example, the groove 69 may extend around substantially all of the perimeter of the desk top 12. The groove 69 may be sized to receive a fastener tab of one of the accessories. The fastener tab may be mounted to the respective accessory for pivotal movement. For example, the pivotal relationship between the fastener tab and respective accessory may be such that the accessory may pivot between at least a first position in which the accessory does not extend over a portion of the desk top 12 and a second position in which the accessory extends over a portion or contacts the desk top 12. For example, in the collapsed position the accessory may extend over and contact the desk top 12 for storage or transport purposes.

FIG. 9*e* shows an exploded view of various examples of components of the desk system 10.

FIG. 9*f* is a side perspective view of the embodiment shown in FIG. 9*a*.

FIG. 9*g* includes partial perspective views of the desk system 10 including a view having a user positioned thereon. In this example, a posture of the user positioned on the desk system may be defined by a substantially upright seated position optimal for spinal health of the user.

FIG. 9*h* is a partial perspective view showing a side portion of the desk top 12.

Figure 9I:
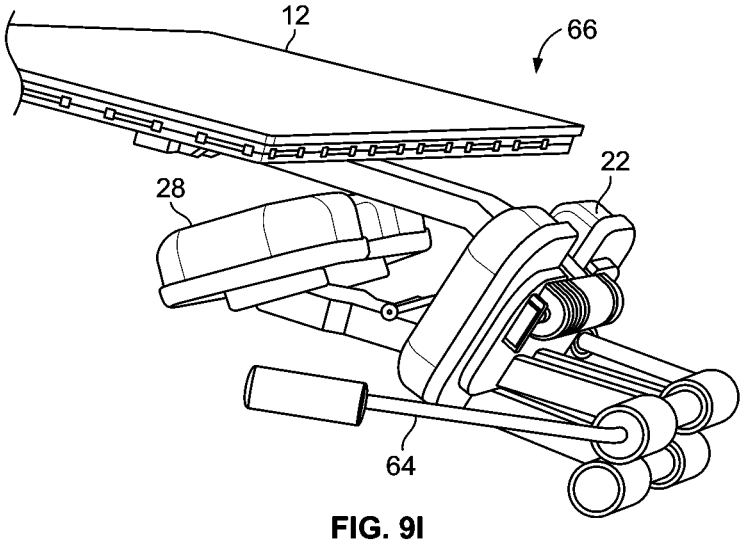
FIG. 9*i* shows the desk system of FIG. 9*a* in a folded or collapsed position.
Figure 9J:
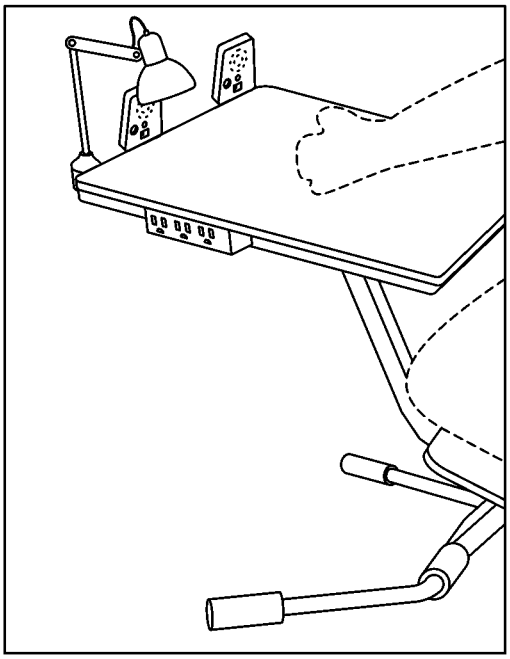
FIG. 9*j* is a fragmentary perspective view of a portion of the desk system of FIG. 9*a*.

FIG. 9*i* is a perspective view of the embodiment of FIG. 9*a* shown partially collapsed.

Figure 10:
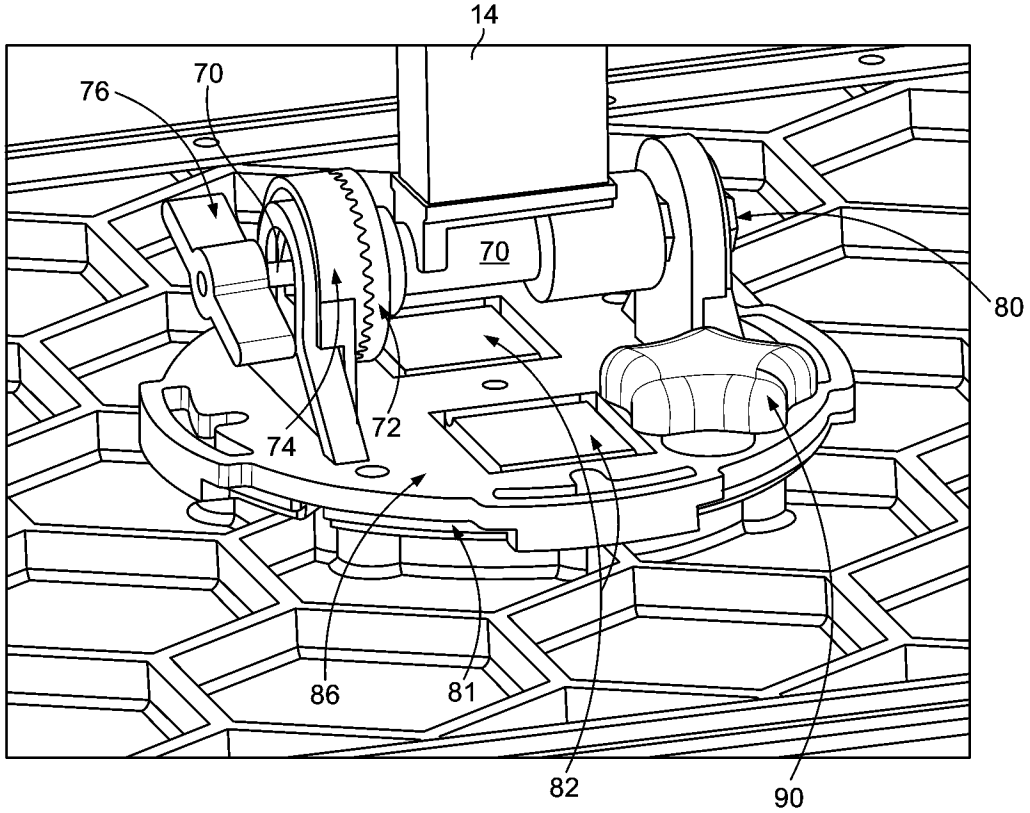
FIG. 10 is an underside perspective view of a pivot assembly for use with a reconfigurable desk system showing various components of mechanisms for adjusting and locking a work surface in a desired position relative to a base of a desk.
Figure 11:
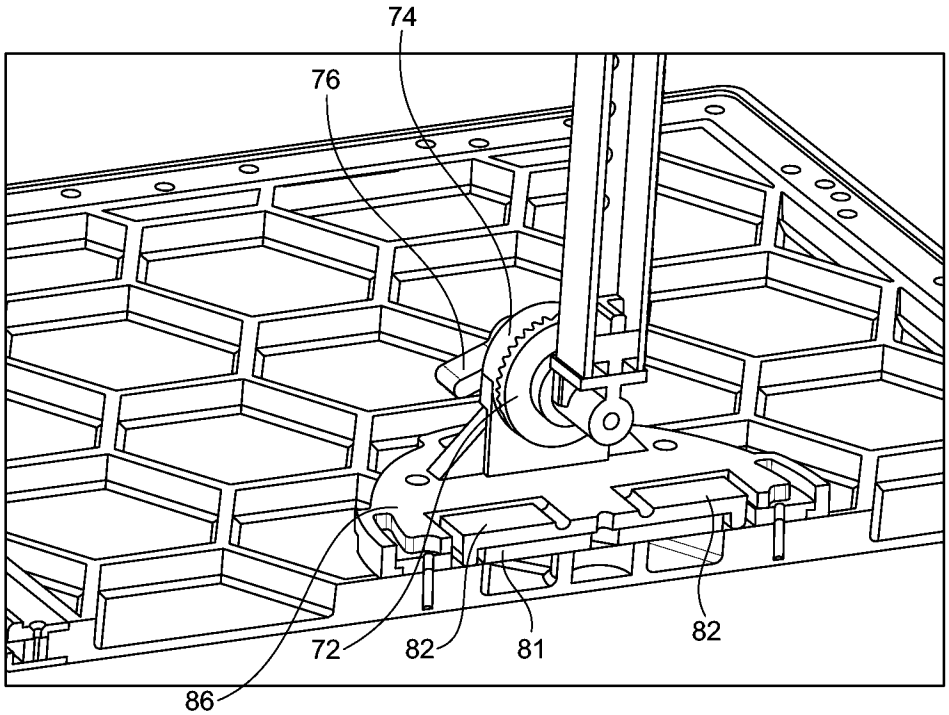
FIG. 11 is a fragmentary perspective view, in cross-section, of portions of the pivot assembly and desk of FIG. 10.

FIGS. 10 and 11 show an example of a swivel mechanism which may assist in rotating the desk top 12 relative to the supporting structure and about an axis normal to the desk top 12. Turning now to FIG. 10 there is illustrated an enlarged perspective view of the pivot assembly 18. It is to be noted that the pivot assembly 24 is similar to the pivot assembly 18.

In FIG. 10 there is shown the inner column 14 connected to a shaft 70 which is rotatably mounted. Connected to one end of the shaft 70 is a toothed wheel 72 which engages a mating toothed member 74. A handle 76 is connected to a shaft 78 that is threaded into a knob 80 in a fixed position. The handle 76 may be turned counter clockwise and the toothed wheel 72 may be loosened and disengaged from the toothed member 74 such that the column 14 is free to rotate and move the desk top 12 to a desired angled position. The handle 76 may be turned clockwise to lock the toothed wheel 72 and the toothed member 74 together and lock the desk top 12 in a fixed position.

The pivot assembly 24 for permitting movement of the column 16 is similarly designed to adjust or retain the column assembly in a fixed position.

The desk top 12 may be rotated relative to an axis normal to the desk top 12. For example, the desk top 12 may rotate between 90 and 180 degrees. Bottom surface projections 82 of the desk top 12 may fit into corresponding openings that are formed in a plate 86 to which is secured toothed member 74. In a normal fixed position, a first plate 86 and a second plate 81 may be retained in their relationship by the knob 90 to which is connected a shaft (not shown) which when loosened permits disengagement of the projections 82 from the openings which permits rotation of the desk top 12. When the plates 81, 86 are in their relocated position the knob 80 may be tightened to retain the plates in the new position.

Figure 12:
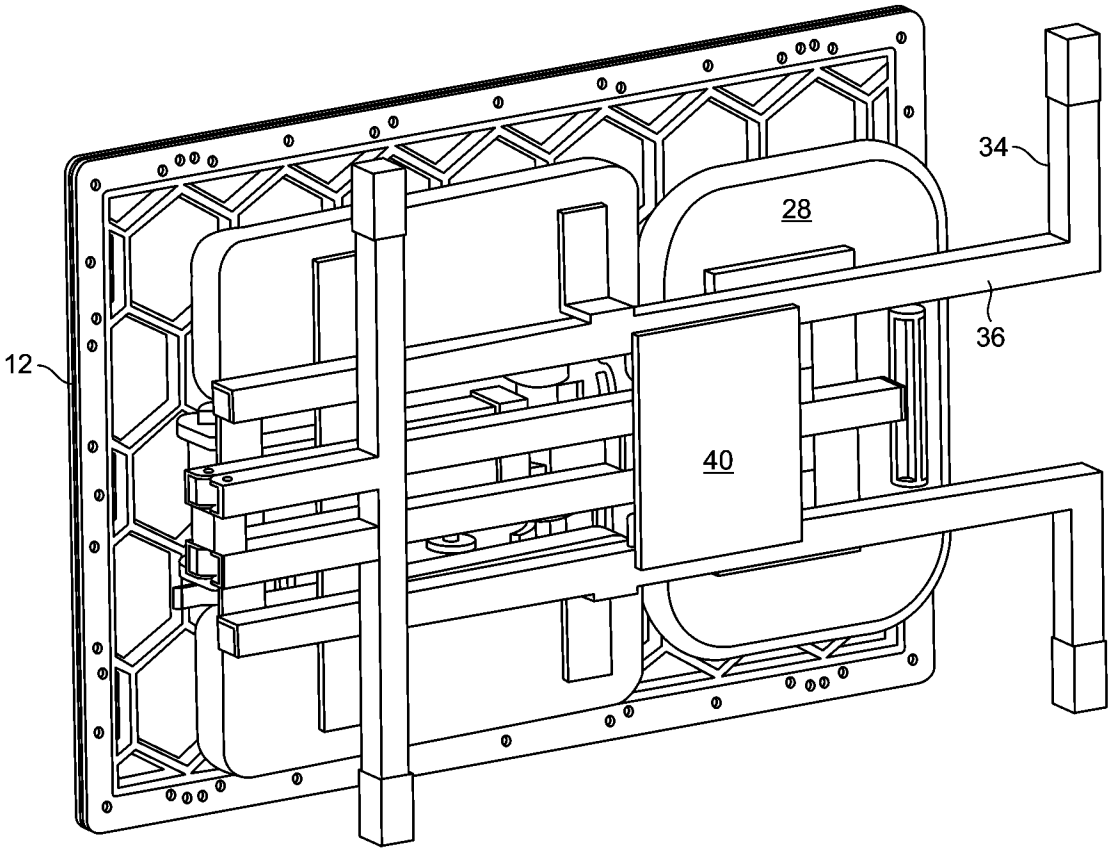
FIG. 12 is a perspective view showing a desk system in a folded or collapsed position.

FIG. 12 is a perspective view of the desk system 10 shown in a collapsed position.

Figure 13:
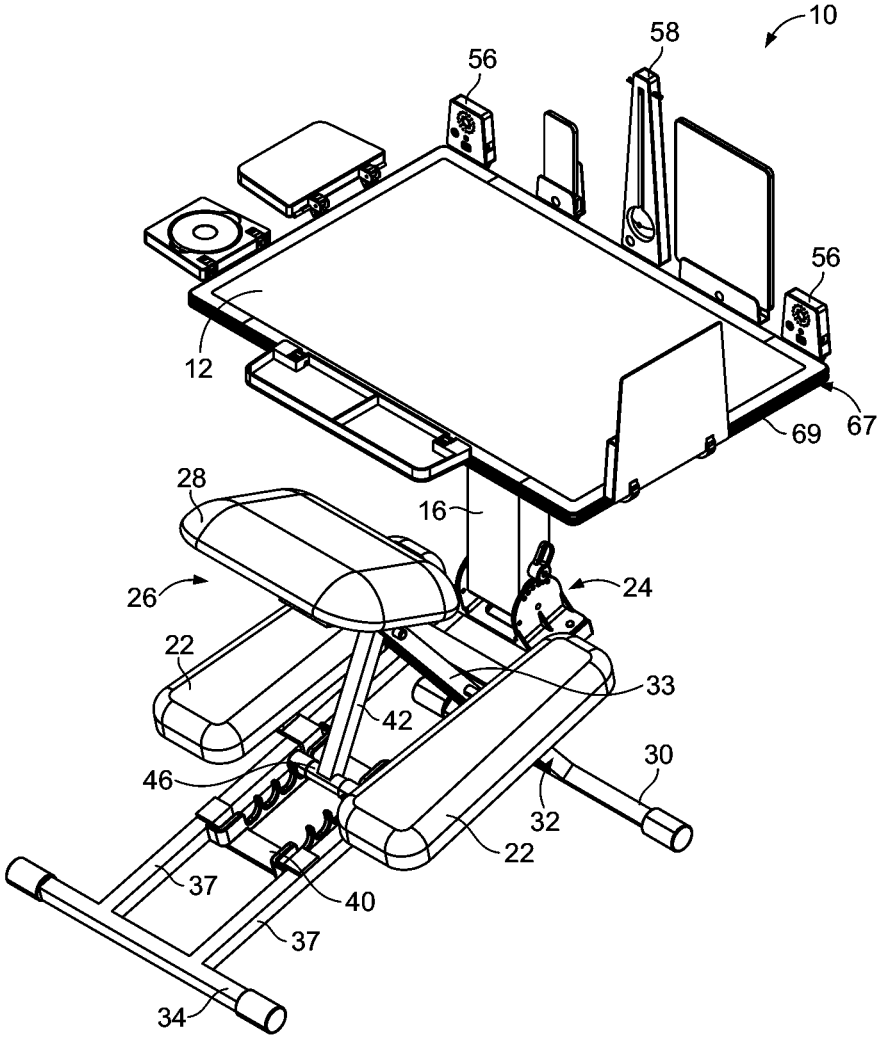
FIG. 13 is a perspective view of an example of a desk system shown in an expanded position.
Figure 14:
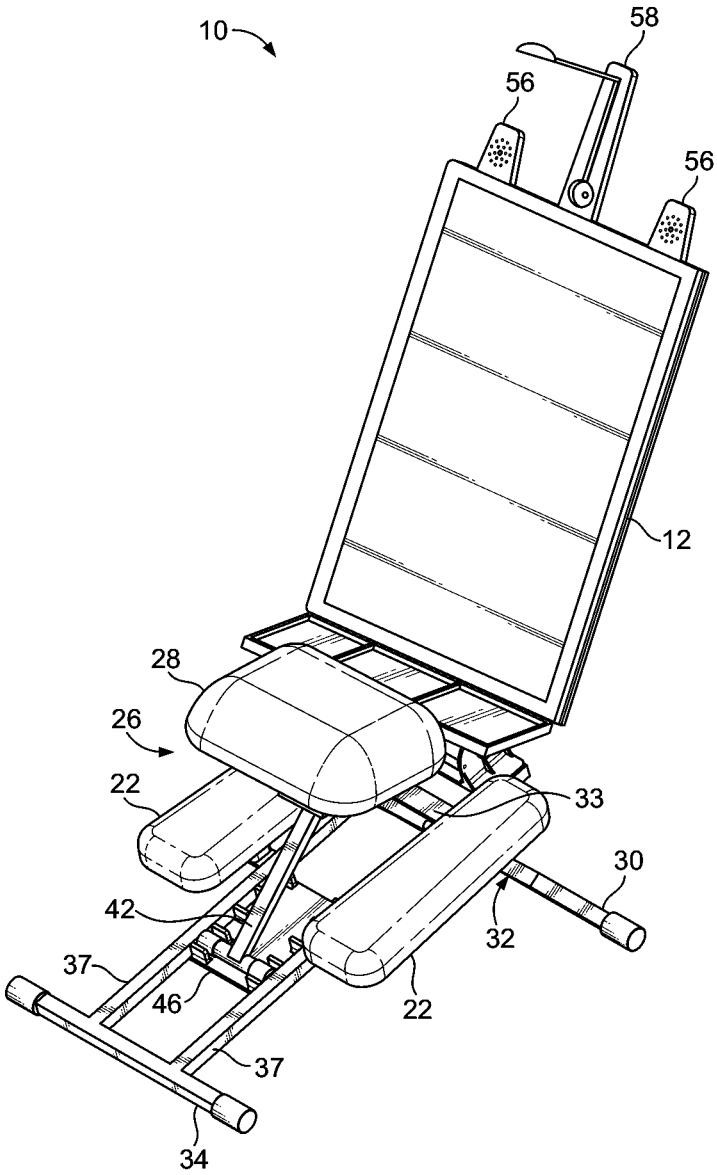
FIG. 14 is a perspective view of the desk system of FIG. 13 shown in an easel position.
Figure 15:
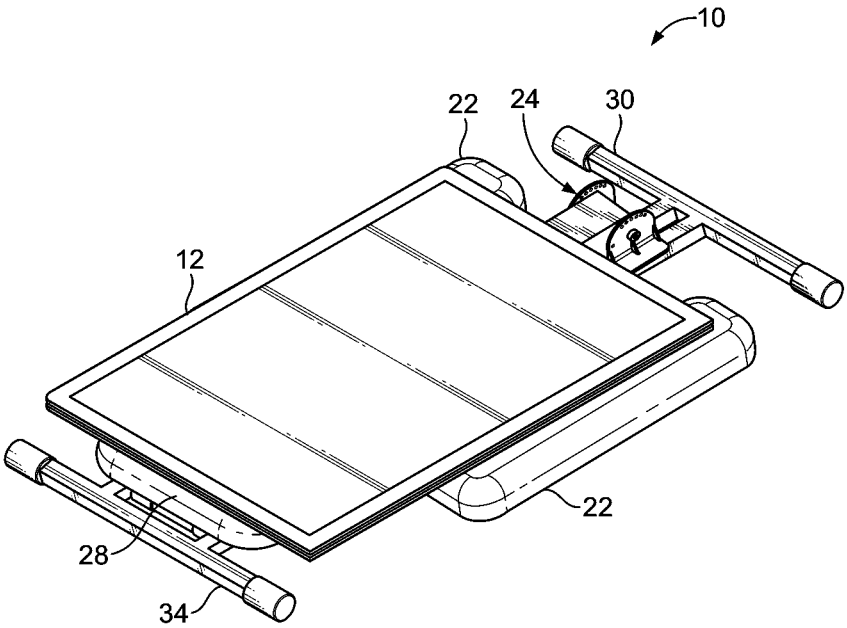
FIG. 15 is a perspective view of the desk system of FIG. 13 shown in a collapsed position.

FIGS. 13 through 15 show another example of the desk system 10. FIG. 13 shows the desk system 10 in the expanded position with the desk top 12 in the landscape configuration and various accessories mounted thereto. FIG. 14 shows the desk system 10 in an easel configuration in which the desk top 12 is oriented in a substantially upright position relative to the underlying surface. Artists are one example of a type of user which may utilize the easel configuration. In this configuration, accessories, such as a light, speakers, and a utensil receptacle may be mounted to the desk top 12 via the groove 69 and respective fastener. FIG. 15 shows the desk system 10 in the collapsed position for transport or storage.

Figure 16:
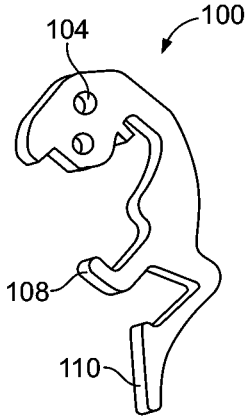
FIG. 16 is a side view of an example of an accessory fastener for mounting to a groove defined by a desk top.
Figure 17:
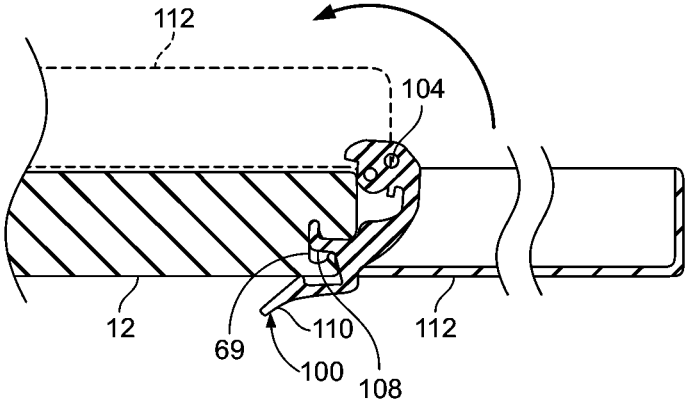
FIG. 17 is a side view, in cross-section, of an example of an accessory fastener mounted to a desk top having a groove sized to receive the accessory fastener.
Figure 18:
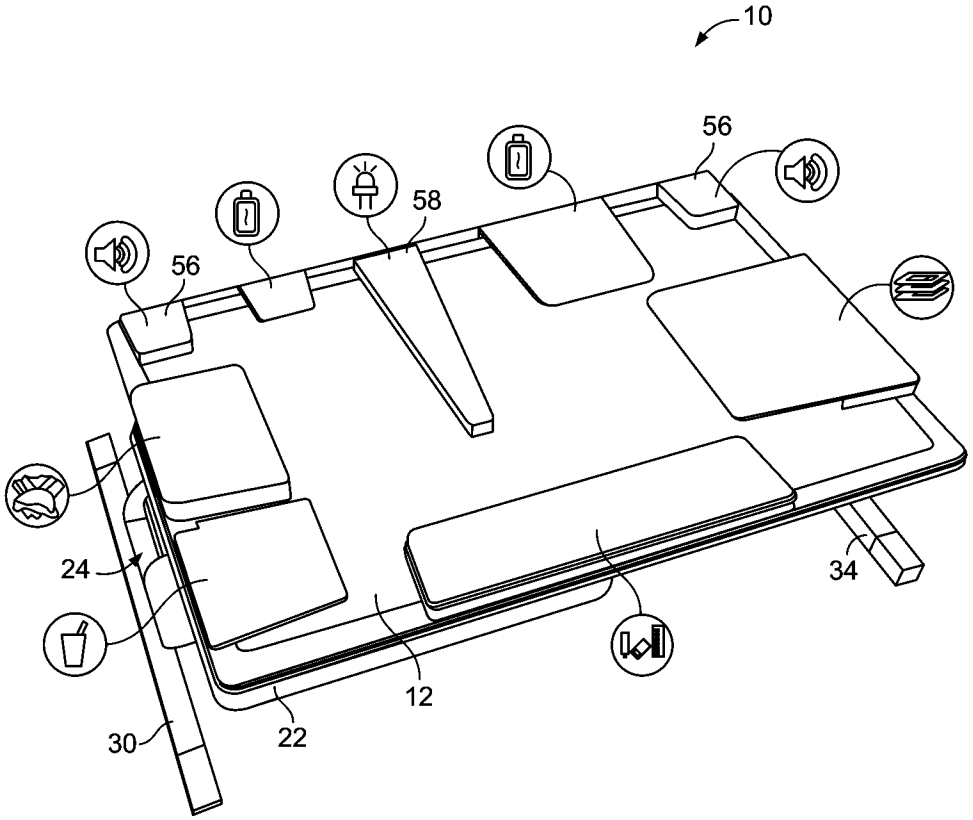
FIG. 18 is a perspective view of an example of a desk system shown with in a collapsed position with accessories folded thereon.

FIGS. 16 and 17 show an example of an accessory fastener, referred to generally as an accessory fastener 100 herein. The accessory fastener 100 may include a mount 104, a first fastener tab 108, and a second fastener tab 110. The accessory fastener 100 may be mounted to a desk top, such as the desk top 12. For example, the first fastener tab 108 may be sized for disposal within a groove, such as the groove 69 of the desk top 12. The second fastener tab 110 may be arranged with the first fastener tab 108 to assist in orienting the accessory fastener 100 relative to the desk top 12. An accessory, such as an accessory 112 may be mounted to the accessory fastener 100 at, for example, the mount 104. The mount 104 may be, for example, a nub or pin sized for reception within the accessory 112 such that the accessory 112 may rotate about an axis in line with the mount 104. For example, FIG. 17 shows an example in which the accessory 112 may rotate between a position in which the accessory 112 does not extend over a portion of the desk top 12 to a position in which the accessory 112 extends over the desk top 12. FIG. 18 shows an example in which multiple accessories are folded onto the desk top 12 where the desk system 10 is in the collapsed position.

The desk systems described above provide users with a workspace option in which a stored desk system may be easily opened as a fully assembled product and adjust to fit their body. Transition between the various positions and configurations does not require additional parts or tools. Accessories may attach to the desk simply and allow the user to customize their workspace according to work needs and style and without obstructing work space of the desk top. The accessories may also fold against the desk top storage. Additionally, the seat and knee supports may positively influence the user's posture while working at the desk and may be adjusted to accommodate various user body types and sizes.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to marketability, appearance, consistency, robustness, customer acceptability, reliability, accuracy, etc. As such, embodiments described as less desirable than other embodiments or prior art implementations with respect to one or more characteristics are not outside the scope of the disclosure and can be desirable for particular applications.

What is claimed is:

1. A collapsible desk system comprising:

first and second elongate members having a common central pivot, and being pivotal relative to one another in a scissor-type manner, and each elongate member having a first end for resting on an underlying surface and second end;

a seat attached to the second end of the first elongate member;

a support member cooperable with the first and second elongate members to selectively retain the elongate members in one or more crossed orientations;

a lower column defining a column cavity and including a lower end attached to the second end of the second elongate member at a lower pivot assembly;

an upper column sized for disposal within the column cavity for telescopic movement and including an upper end attached to an upper pivot assembly having a pair of spaced apart semi-circular plates with a plurality of apertures arranged in an arc and a shaft rotatably mounted to the pair of spaced apart semi-circular plates and the upper end; and a desk top attached to the upper pivot assembly for pivotal movement and retention, wherein the members, seat, column, and desk top are arranged with one another to transition between at least a collapsed and an expanded position.

2. The desk system of claim 1, further comprising a knee support mounted to one of the elongate members.

3. The desk system of claim 1, further comprising a swivel mechanism to rotate the desk top about a swivel axis normal to the desk top.

4. The desk system of claim 3, wherein the desk top defines a rectangular shape and wherein the swivel mechanism is configured to enable the desk top to rotate ninety degrees.

5. The desk system of claim 4, wherein the swivel mechanism and the pivotal attachment of the desk top cooperate to orient the desk top in an easel configuration in which the desk top is in a substantially upright position relative to the underlying surface.

6. The desk system of claim 1, wherein the desk top pivots about a generally horizontal transverse axis relative to the column.

7. The desk system of claim 1, wherein the support member is a strut pivotally connected to one of the elongate members and engageable with the other of the elongate members at a plurality of spaced apart locations in order to vary a height of the desk top when the system is in the expanded position.

8. The desk system of claim 1, wherein the support member is pivotally attached to one of the elongate members.

9. The desk system of claim 1 further comprising an accessory including a first fastener tab, wherein the desk top defines a side face having a groove extending about at least a portion of a perimeter of the desk top with the groove sized to receive the first fastener tab.

10. The desk system of claim 9, wherein the first fastener tab defines a mount cooperable with the accessory such that the accessory may rotate between at least a first and second position.

11. The desk system of claim 1, further comprising a lock mechanism to selectively engage the column in one or more positions.

12. The desk system of claim 1 further comprising an accessory attached to a groove defined by a side face of the desk top and pivotal between a cantilevered outboard position and an inboard position at least partially extending over a portion of the desk top, wherein the accessory is selected from a group of a light device, a mobile phone dock, a tablet dock, a cup holder, a utensil receptacle, a speaker, a snack tray, a makeup mirror, a cord organizer, a book holder, a file receptacle, one or more clips, or an art supply holder.

13. A workspace system comprising:

a desk top defining a top surface, a side surface, an under surface, and a groove in the side surface extending about at least a portion of a perimeter of the desk top:

a fastener complimentary to the groove and including a first tab sized for insertion within the groove and a second tab for contacting the under surface to retain the fastener in place; and a desk top device pivotally mounted to the fastener such that the desk top device may pivot between a first position in which the desk top device does not extend over the top surface and a second position in which the desk top device rests upon the top surface or extends over the top surface.

14. The workspace system of claim 13, wherein the desk top device is selected from a group of a light device, a mobile phone dock, a tablet dock, a cup holder, a utensil receptacle, a speaker, a snack tray, a makeup mirror, a cord organizer, a book holder, a file receptacle, one or more clips, or an art supply holder.

15. The workspace system of claim 13, further comprising:

a support structure supporting the desk top thereon and having a lower portion for resting on an underlying surface and an upper portion; and a seat assembly mounted to the upper portion of the support structure, having a seat and knee support, and arranged with the desk top to position a user proximate the top surface.

16. A reconfigurable desk system comprising:

a support structure having first and second elongate members each with first ends for at least partially resting on an underlying surface;

a lower column defining a column cavity and including a lower end attached to a second end of one of the elongate members at a lower pivot assembly;

an upper column sized for disposal within the column cavity for telescopic movement and including an upper end attached to an upper pivot assembly having a pair of spaced apart semi-circular plates with a plurality of apertures arranged in an arc and a shaft rotatably mounted to the pair of spaced apart semi-circular plates and the upper end;

a desk top pivotally mounted to the upper end at an upper pivot assembly;

a swivel mechanism cooperable with the desk top to rotate the desk top about an axis normal thereto; and a seat assembly mounted to the support structure to position a user proximate the desk top, wherein the lower pivot assembly, the upper pivot assembly, and the swivel mechanism are arranged with one another such that the desk may transition between a landscape configuration in which the desk is oriented in a substantially horizontal position relative to the underlying surface and an easel configuration in which the desk is oriented in a substantially upright position relative to the underlying surface.

17. The desk system of claim 16, further comprising a knee support mounted to one of the elongate members and arranged with the seat assembly such that a posture of a user positioned thereon is defined by a substantially upright seated position optimal for spinal health of the user.

18. The desk system of claim 16, wherein the desk top defines a side face extending about a perimeter thereof and having a groove sized to receive a fastener tab of an accessory.

19. The desk system of claim 18, further comprising an accessory attached at the groove and pivotal between at least first and second positions.

20. The desk system of claim 16, wherein the lower column is pivotally mounted the second end of one of the elongate members to adjust a location of the desk top relative to the seat assembly.

* * * * *